US005347756A

United States Patent [19]

Abbott et al.

[11] Patent Number: 5,347,756

[45] Date of Patent: Sep. 20, 1994

[54] PIVOTAL AND ADJUSTABLE CLOSURE VERTICAL RAIL LOUVER SYSTEM

[76] Inventors: Christopher E. Abbott, 632 Overhill Rd., Ardmore, Pa. 19003; Glenn T. Mushrush, 98 Hemlock Dr., Concordville, Pa. 19331

[21] Appl. No.: 46,402

[22] Filed: Apr. 12, 1993

[51] Int. Cl.[5] ..... E05F 17/00

[52] U.S. Cl. ..... 49/74.1

[58] Field of Search ..... 49/74.1, 82.1, 403; 454/221, 224, 278

[56] References Cited

U.S. PATENT DOCUMENTS

| | | | |
|---|---|---|---|
| 390,392 | 10/1888 | Ness | 49/403 X |
| 702,148 | 6/1902 | Nettleton | 49/403 |
| 2,026,653 | 1/1936 | Raleigh | 49/74.1 |
| 2,311,122 | 2/1943 | Niesner | 454/221 |
| 2,921,819 | 1/1960 | Rifkin | 49/74.1 X |
| 3,137,043 | 6/1964 | Moeller | 49/403 |
| 3,191,241 | 6/1965 | Johnson | 49/403 |
| 3,591,980 | 7/1971 | Cheng | 49/403 X |
| 3,706,165 | 12/1972 | Baldrich | 49/403 |
| 4,744,290 | 5/1988 | Josephson | 49/403 X |
| 4,996,793 | 3/1991 | Mazur | 49/74.1 |

*Primary Examiner*—Peter M. Cuomo
*Assistant Examiner*—Jerry Redman
*Attorney, Agent, or Firm*—John B. Sowell

[57] ABSTRACT

An adjustable closure rail system is provided with a fixed top rail and a fixed bottom rail and a plurality of pivotal louvers mounted therebetween on friction free spindles and bushings. Each said louver is provided with a pivot link mounted in the top end of said louvers and is offset from the spindles or bushings which pivotally mounts said louvers. And a universal link bar is provided for cooperating with each of the pivot links so that pivotal force movement of one of said vertical louvers imparts the same pivotal force motion via said pivot links and said universal link bar to each of said other louvers.

12 Claims, 4 Drawing Sheets

PIVOTAL AND ADJUSTABLE CLOSURE VERTICAL RAIL LOUVER SYSTEM

BACKGROUND OF THE INVENTION

1. Field of the Invention

The present invention relates to rail systems and more particularly relates to a novel vertical rail system having adjustable closure louvers instead of conventional fixed rails.

2. Description of the Prior Art

Class 49, subclasses 73 to 76, 95 and 96, etc. related to closures which are interconnected for concurrent movement. These subclasses include numerous forms of horizontal shutters, louvers and conventional jalousies which are provided with various forms of actuators or closing mechanisms. The prior art in this class and subclasses did not reveal any shutters, louvers or jalousies adapted to act as an adjustable rail system nor were the shutters or louvers mounted in the vertical direction and adapted to support a horizontal rail or fence or barrier under force.

SUMMARY OF THE INVENTION

It is a primary object of the present invention to provide a novel modular rail system for use on decks, patios, porches and fences.

It is another principal object of the present invention to provide a novel adjustable closure vertical rail system which adjusts for an open rail or a closed wall or any system therebetween.

It is primary object of the present invention to provide a modular vertical rail system which is pivotable by application of a small force on a single vertical rail.

It is another primary object of the present invention to provide a pivotal louvered rail system for out of doors installation that is resistant to change by a high wind.

It is another principal object of the present invention to provide an adjustable closure system having easily removable and/or replaceable louvers or rails.

It is another object of the present invention to provide an adjustable closure system for closed view and open air ventilation at the same setting.

It is another object of the present invention to provide an aesthetic adjustable rail system which is expandable in the vertical and horizontal directions to fit variable sizes of open spaces.

It is another object of the present invention to provide an adjustable and modular rail system which meets all Builders Official Code Association (BOCA) safety standards.

It is another primary object of the present invention to provide a novel adjustable louver rail system which is provided with 180° reversibility for adjusting wind, light and air.

It is another principal object of the present invention to provide an overlapping louver system which provides a ventura effect in a high wind so as to stabilize the setting of the louvers.

It is another object of the present invention to provided a novel adjustable rail louver system having vertical rails stronger than standard fixed rails and yet provides a spacing and overlap to provide a kid proof system whether opened or closed.

In accordance with these and other objects of the present invention, there is provided an adjustable closure vertical rail system having a fixed horizontal top rail and a fixed horizontal bottom rail and a plurality of vertical louvers that are pivotally mounted in the top and bottom rails therebetween. Male and female pivot spindle means are inserted in the rails and louvers to provide means for pivoting the vertical louvers and there is further provided a novel male link spindle mounted in the top of each of the pivotal louvers that is offset from the male and female pivot bushing and spindle means. The male spindles are interconnected by a universal link bar having a plurality of female bushing adapters therein for pivoting all louvers simultaneously. The universal link is further adapted to be adjusted along the length of the universal link bar for use with variable sizes and spacing of vertical pivoting louvers.

DESCRIPTION OF THE PREFERRED EMBODIMENT

Figure 1:
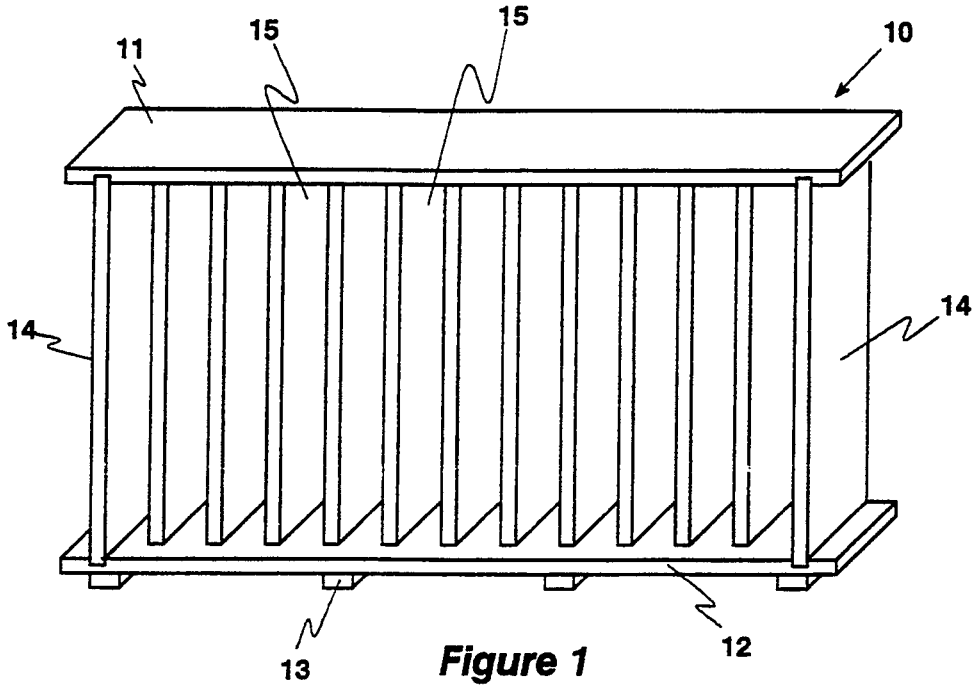
FIG. 1 is a front elevation of a preferred embodiment adjustable rail system.

Refer now to FIG. 1 showing a front elevation of a preferred embodiment adjustable rail system 10. The rail system 10 is provided with a top rail 11 and a bottom rail 12 supported by support blocks 13. The bottom and top rails 12 and 11 are shown connected to side rails 14 which establish a rigid rectangular structure for support of the pivotal louvers 15 therebetween.

Figure 2:
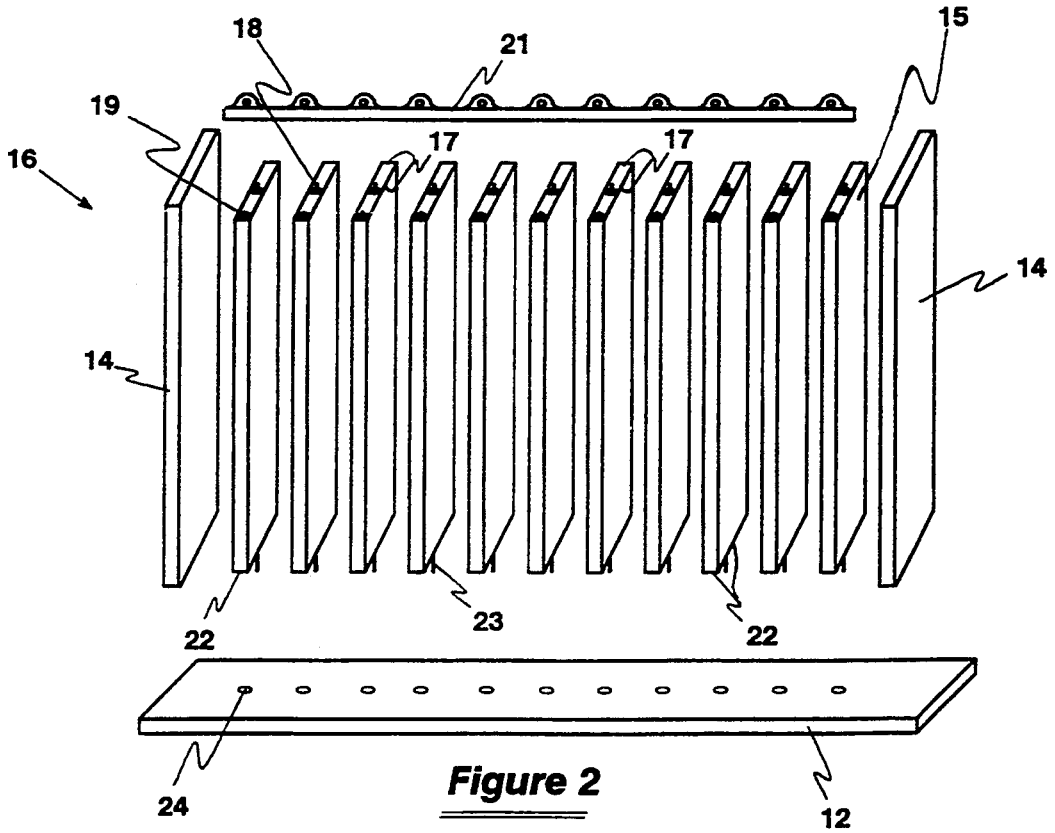
FIG. 2 is a partial exploded view in front elevation of another preferred embodiment adjustable rail system.

Refer now to FIG. 2 showing a partial exploded view in front elevation of another preferred embodiment adjustable rail system 16. The system 16 differs from the aforementioned system 10 in that the side rails 14 abut the end of the bottom rail 12 and the top rail 11 (not shown). The system 10 is preferred when several systems 10 are aligned abutting one against the other because then the spacing between louvers is uniform and appears as a continuous rail. However, when the modular system is installed abutting a large support post, the system 16 is preferred. The louvers 15 of the system 16 are shown having a top edge 17 with a pair of spindles 18 and 19 extending therefrom. The spindle 18 is centrally located in the top edge 17 and comprises the male pivot means for pivoting the louvers 15. The spindle 19 cooperates with the universal link bar means 21 which will be explained in greater detail hereinafter. Each of the louvers 15 is provided with a bottom edge 22 shown having a male spindle 23 extending therefrom. The male spindles 23 in each of the louvers 15 is adapted to cooperate with a bushing 24 in the bottom rail 12. It will be understood that when any one of the louvers 15 is manually adjust on its pivots 18 and 23, the link bar 21 will cause all of the louvers 15 to move together in tandem.

Figure 3:
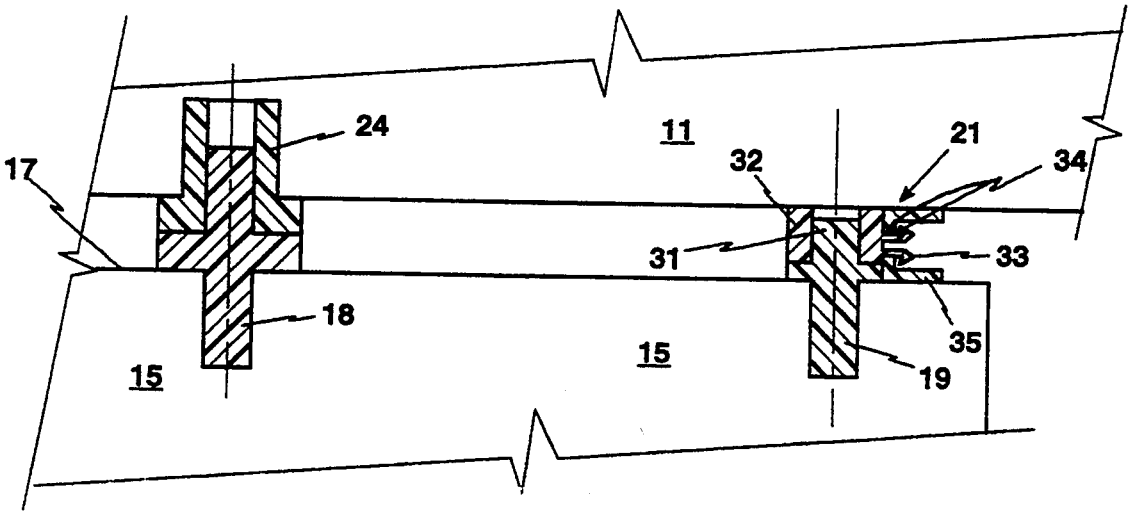
FIG. 3 is an enlarged elevation in partial section taken through the bottom and top edges of a pivotal louver shown in FIGS. 1 and 2.
Figure 3:
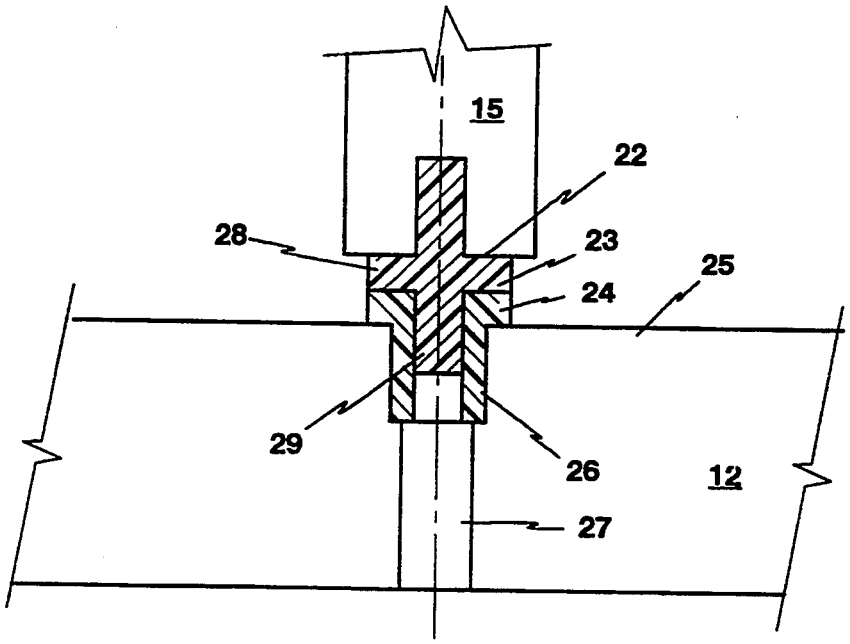

Refer now to FIG. 3 showing an enlarged elevation in partial section taken through the bottom edge 22 and the top edge 17 of the louvers 15. The bushing 24 shown in bottom rail 12 is installed above the top surface 25 of the bottom rail 12, but may be installed flush with the top surfaced 25 by countersinking a recess for the flange portion of bushing 24. Further, bushing 24 is shown having an internal cylindrical bearing surface 26 which extends through the bushing 24 and into a drain recess through the bottom rail 12. The male spindle 23 is shown having a flange portion 28 and a pivot pin portion 29 for bearing on and guiding in the bushing 24. The preferred embodiment bushing 24 and pivot spindle 23 are made from a hard plastic such as DELRIN (TM) made by Dupont or a cast NYLON (TM) also made by Dupont which are self-lubricating and substantially friction free. It will be understood that in the preferred embodiment the bushing 24 is inserted into the bottom rail 12 even though the positions of bushing 24 and the spindle 23 may be reversed. Since the spindle has the smaller diameter and is least likely to splint the louver 15, in the preferred embodiment, the bushing 24 is installed in the bottom rail 12. A bushing 24 is shown installed in the top rail 11 and cooperates with a spindle 18 which is identical to the spindle 23 described hereinbefore. The reason for installing the smaller diameter spindle 18 in the top of the louver 15 is the same as explained hereinbefore for the bottom edge 22.

A male link spindle 19 is installed in the top edge 17 of the louver 15 and is offset from the spindle 18. The top guide pin 31 of the spindle 19 is shown guided in a cylindrical recess of a bushing portion 32 of the universal link bar 21. The universal link bar is preferably made in two separate and distinct pieces. The first piece includes the bushing 32 and is provided with expanded prongs 33 which extend through recesses 34 in the modular bar 35. As will be explained hereinafter, the recesses 34 are punched or drilled holes along the bar at uniform spacings which may vary from 1 up to 2" depending on the width or size of the louver to be actuated. If the recesses 34 are spaced a half inch apart, it is possible to install the universal link bar bushings 32 on any spacing in increments of a half inch, thus providing a uniform modular bar for use with all size louvers used on decks or patios.

Figure 4:
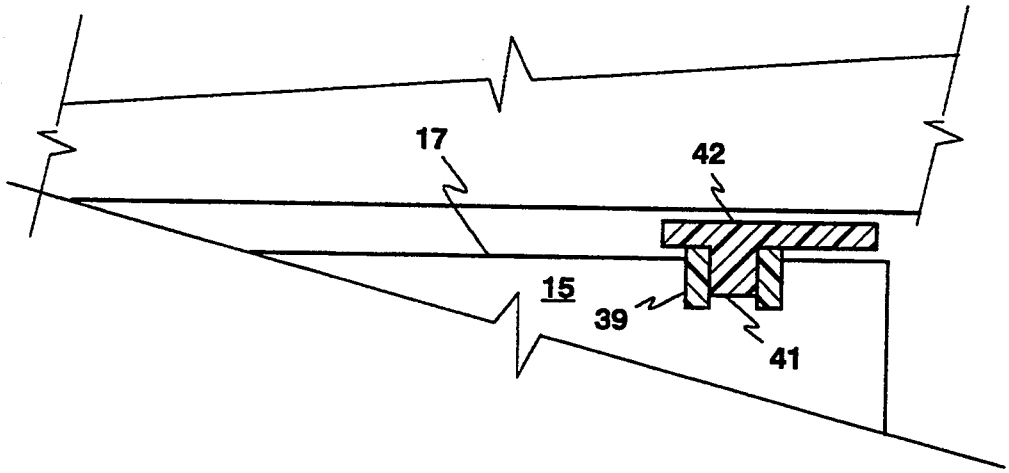
FIG. 4 is an enlarged elevation in partial section taken through the bottom and top edges of a modified preferred embodiment pivotal louver shown in FIGS. 1 and 2.
Figure 4:
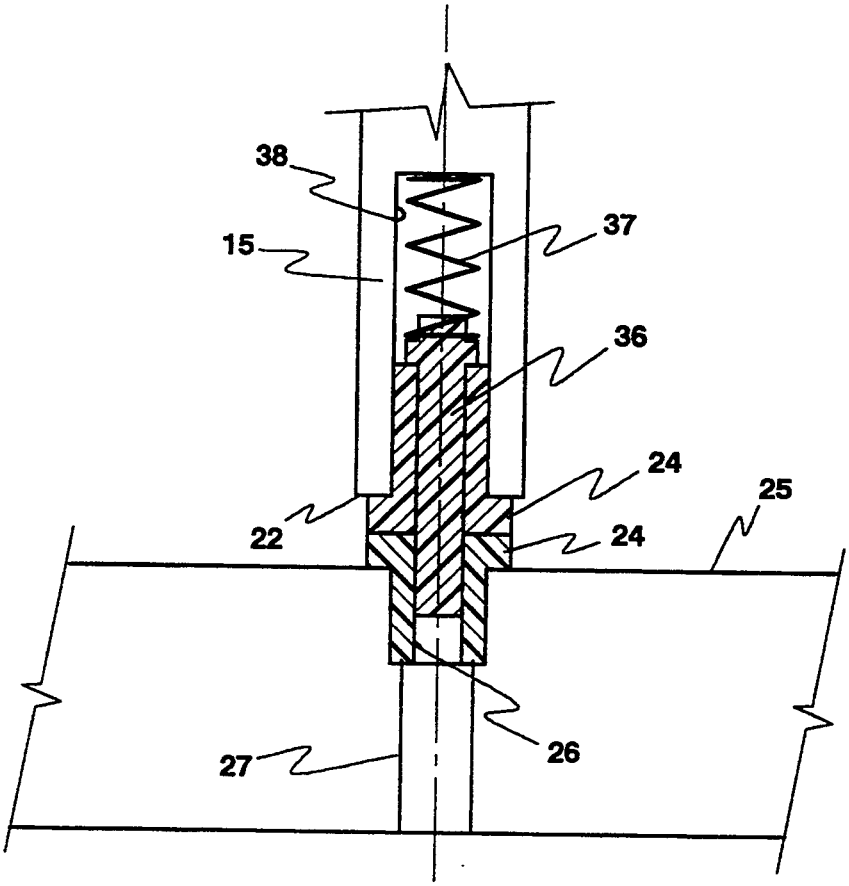

Refer now to FIG. 4 showing an enlarged elevation in partial section taken through the bottom and top edges 25 and 17 of a louver 15 and showing a modified pivot system for the louver 15. The modified louver system of FIG. 4 is preferably used for removing louvers 15 or providing a removable louver system. In the preferred embodiment of the present invention, the FIG. 4 modification is used when replacing a FIG. 3 type louver 15. However, the original system may be provided with removable louvers if so desired. The removable louver system comprises a downward extending bushing 24 which extends into the bottom rail 12 and an upward extending bushing 24 which extends into a recess 38 of the louver 15. A spring bias plunger 36 is shown biased by spring 37 through the recesses in bushings 24. To remove the louver 15, it is only necessary to extend a wire or object through the drain hole 27 to compress the plunger 36 upward against the spring 36 until it is free from the recess 26 in the lower bushing 24. When this occurs the whole louver 15 may be slipped sideways and completely removed enabling the louver to be replaced or repaired.

Having already explained that the universal link bar 21 is preferably made in two pieces and that the operation of the spindles and bushings may be reversed, it will be understood that a small bushing 39 may be inserted through the top edge 17 of the louver 15 to provide a frictionless recess for a guide pin 41 which extends from a simple universal link bar shown in the form of a rectangular structure 42.

Figure 5:
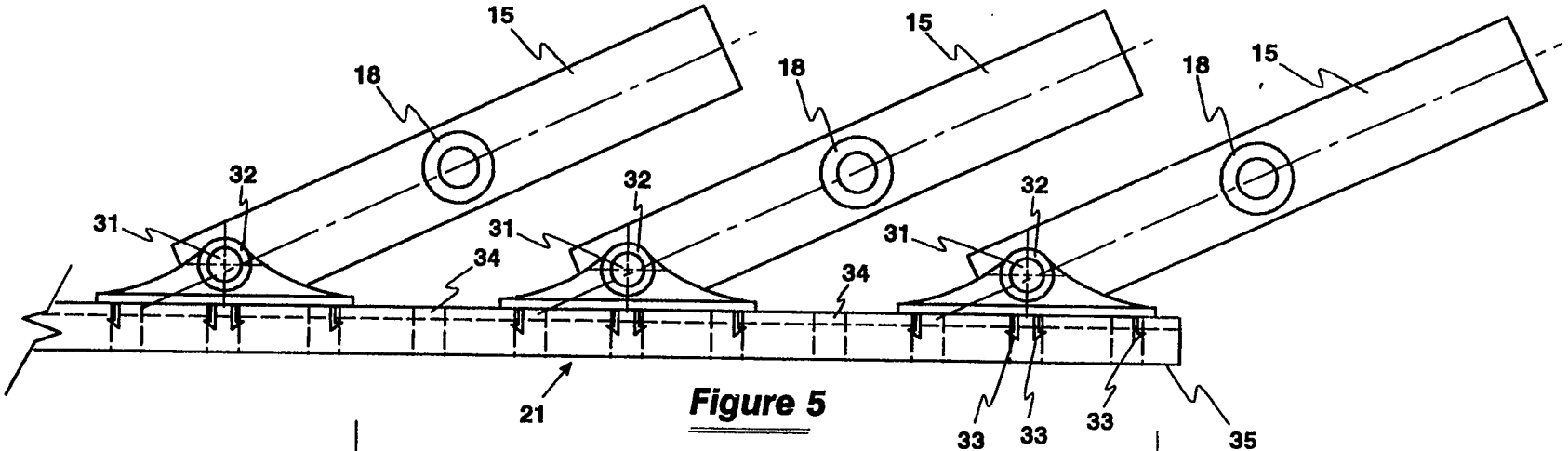
FIG. 5 is an enlarged top view of a preferred embodiment universal link bar of the type shown in FIG. 2 with the louvers substantially closed.

Refer now to FIG. 5 showing an enlarged top view of the preferred embodiment universal link bar 21 which comprises the aforementioned modular bar 35 and the novel bushing 32 which is provided with a plurality of expandable prongs 33 which extend through the uniformly provided apertures or recesses 34 in the modular bar 35. Thus, it will be understood that the universal link bar 21 may have its bushing spaced apart at a set number of recess intervals 34 to provide modular spacing for different sizes of louvers 15. There is shown installed in the top and center of the louvers 15 a spindle 13 which provides half of the pivot means for any particular louver. The spindle 19 having a top guide pin 31 extends through the central aperture in the bushing 32. It will be understood that movement of the bar 35 to the right in FIG. 5 will cause the louvers 15 to pivot counter clockwise as the bushings 32 rotate relative to the pins 31. Since the louvers are always overlapping, it is possible to rotate the louvers 15 clockwise until the edges of the louvers touch each other. The louvers 15 are free to be rotated from this position approximately 180° in the counter clockwise position to achieve the same touching position in the opposite direction.

Figure 6:
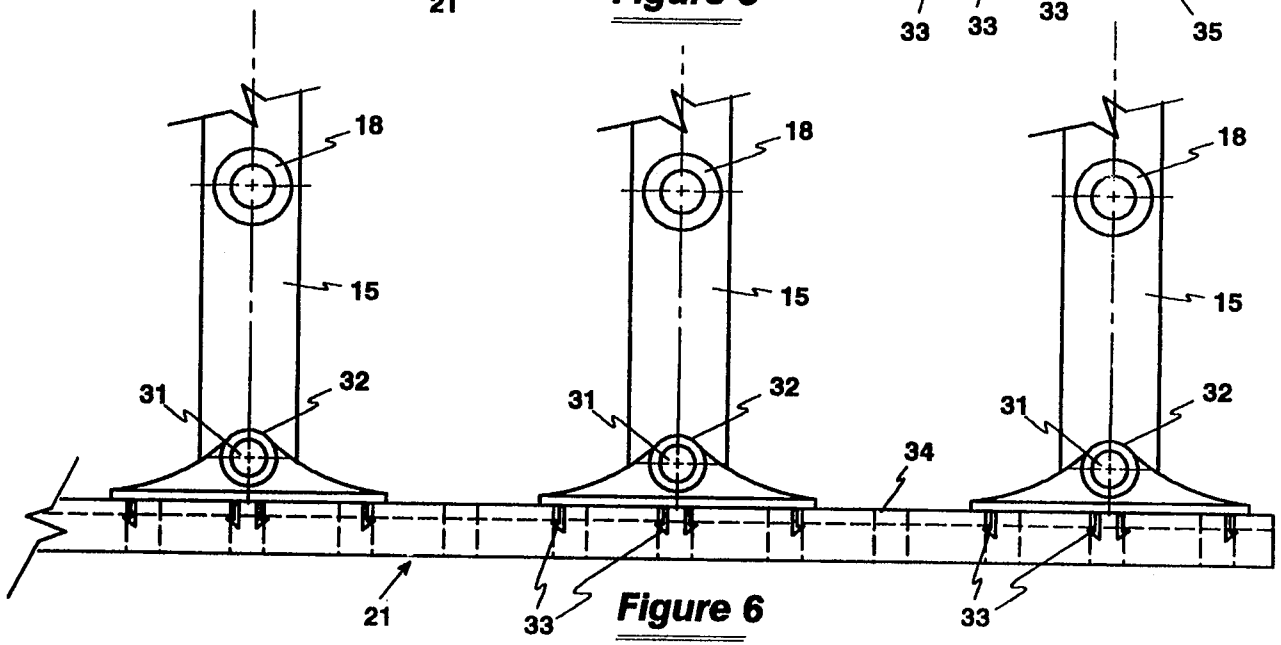
FIG. 6 is an enlarged top view of a preferred embodiment universal link bar of the type shown in FIG. 2 with the louvers fully open.

Refer now to FIG. 6 showing an enlarged top view of a preferred embodiment universal link bar 21 as shown in FIG. 5. However, the louvers 15 are now in their full open position. When it is desirable to rotate the louvers in a clockwise or counter clockwise direction, the preferred usage of the present invention is to grasp one of the edges of a vertical louver 15 and move the one louver to the desired position which in turn causes movement through the universal link bar 21 which moves the other louvers to the identical rotated position.

It is a feature of the present invention that the vertical louvers are very easy to move with a small force because of the frictionless spindles and bushings employed. It would appear that any wind would cause the shutters to move or flap. However, this is not the case. When a wind force is encountered, in any direction it will cause a ventura effect of wind to pass through any open louver. Thus, the force on one end of the louver is attempting to move the louver in one direction and the ventura effect attempts to move the louver in the other direction, thereby stabilizing the louver in a fixed position. When the wind is applied directly to a closed louver system, each of the ends of the louver is pressing on the adjacent louver which attempts to keep the louver closed, thus, the louver maintains its closed position. When the wind is approaching the louvers at an angle which drives wind between the adjacent louvers, it is possible to build up an opening force against adjacent louvers which counteracts the closing force by the wind acting on the opposite side of the louver.

Having explained a preferred embodiment of the present invention and minor modifications of the pivot means it will be appreciated that the present louver system is in fact a structural rail which will support a substantial force and the bearings are so designed to transmit this force between the top rail 11 and the bottom rail 12. The reason for employing the support blocks 13 is to assure that there is no flexing of the bottom and top rails which are preferably twice as thick as the louvers 15. In the preferred embodiment of the present invention, the width of the louvers may be anywhere from 4 to 12 inches wide in modules of 2 inches employing a standard universal link bar 21 to achieve the desired movement of the louvers and overlap spacing as described hereinbefore. However, it will be understood that BOCA safety standards prohibit the distance between rails from exceeding four inches. Thus, using one inch thick louvers, the maximum space between centers on louvers should not exceed 5 inches and preferably should be even less to accommodate the safety standard.

What is claimed is:

1. An adjustable closure vertical rail system, comprising:

a fixed horizontal top rail, a fixed horizontal bottom rail, a plurality of vertical louvers having top and bottom ends pivotally mounted in said top rail and said bottom rail, a pivot spindle mounted in the top and bottom ends of each of the pivotally mounted louvers, pivot bushing means in said top and bottom horizontal rails coaxially aligned for receiving the pivot spindle therein, a link spindle mounted in the top end of each of said pivotally mounted louvers offset from said pivot spindle, universal link bar means comprising a link bar and a plurality of link bushing adapters, said link bar having a channel and spaced apertures within said channel, said link bushing adapters being coupled to less than all of said apertures in said channel at variable predetermined distances along said link bar and each adapted to receive one of said link spindles, and whereby said plurality of vertical louvers are pivotally connected by said universal link bar means along their top edges below said top rail so that pivotal movement of one louver imparts the same pivotal movement to the other vertical louvers so that said plurality of louvers move together as a system.

2. An adjustable closure rail system as set forth in claim 1 wherein said link bar means is mounted between the top of said louvers and said top rail.

3. An adjustable closure rail system as set forth in claim 2 wherein said louvers are wider than the distance between adjacent pivot means in said louvers so that said louvers are adapted to close one against the other in one of two positions when pivoted approximately 180°.

4. An adjustable closure rail system as set forth in claim 1 whereby said modular spaced attachment means comprises cylindrical apertures in said link bar means for receiving male coupling means therein.

5. An adjustable closure rail system as set forth in claim 1 wherein said link bar comprises a plastic channel shaped flange member.

6. An adjustable closure rail system as set forth in claim 1 wherein one of said pivot spindle means is mounted in the bottom of one of said louvers and comprises an elongated replacement plunger spindle movably mounted in an oversize recess in the bottom end of said louver, and spring means mounted on said replacement plunger spindle for biasing said replacement plunger spindle into engagement with one of said pivot bushing means mounted in the bottom rail.

7. An adjustable closure rail system as set forth in claim 6 which further includes one of said pivot bushing means comprises a first pivot bushing mounted in the bottom end of said louvers having said replacement plunger spindle extending therethrough, and a second pivot bushing in the bottom rail and said pivot bushings being coupled together by said replacement plunger spindle extending therethrough.

8. An adjustable closure rail system as set forth in claim 1 wherein said pivot bushing means, said pivot spindle, and said link bar means are made of a hard anti-friction plastic.

9. An adjustable closure rail system as set forth in claim 1 wherein said pivot bushing means, said pivot spindle and said link bar means are made from a non-hydroscopic dimensionally stable plastic which is insensitive to ultraviolet light.

10. An adjustable closure rail system as set forth in claim 1 wherein said bushing means, said pivot spindle and said link bar means are made from an acetal polymer.

11. An adjustable closure vertical rail system, comprising:

a fixed horizontal top rail, a fixed horizontal bottom rail, a plurality of vertical louvers each having top and bottom ends pivotally mounted in said top and bottom rails, a male pivot spindle, female pivot bushing means, one said pivot spindle or said bushing means being fixed in a recess in the top and the bottom ends of said vertical louvers and the other of said bushing means or a pivot spindle being fixed in a recess in said top or bottom rails for pivotally mounting a pivot spindle in said bushing means and for pivotally mounting said louvers between said top and said bottom rails, pivot link means mounted in the top ends of each of said pivotally mounted louvers and being offset from said spindle and said bushing means, universal link bar means comprising a link bar and a plurality of link bushing adapters attached thereto, said link bar having a channel and spaced apertures within said channel whereby said link bushing adaptor may be spaced at variable predetermined distance along said link bar and coupled to said pivot link means, and said universal link bar means having coaxial pivot pin means cooperating with each of said pivot link means, whereby pivotal movement of one of said vertical louvers imparts the same pivotal motion via said pivot link means and said universal link bar means to said other louvers.

12. An adjustable closure vertical rail system, comprising:

a fixed horizontal top rail, a fixed horizontal bottom rail, a plurality of vertical louvers having top and bottom ends each being pivotally mounted in said top and bottom rail, a pivot spindle mounted in the top and bottom ends of each of the pivotally mounted louvers, pivot bushing means in said top and bottom horizontal rails coaxially aligned for receiving a pivot spindle therein, a link bushing mounted in the top end of each of said pivotal louvers offset from said pivot spindle, universal link bar means comprising a link bar and a plurality of link bushing adapters, each being adapted to engage in one of said link bushings, said link bar having a channel and spaced apertures within said channel, said link bushing adapters being coupled to less than all of said apertures in said channel means at variable predetermined distance along said link bar so that said bushing adapters may each be coupled to one of said link bushings, and whereby said plurality of vertical louvers are pivotally connected by said universal link bar means along their top edges below said top rail so that pivotal movement of one louver imparts the same pivotal movement to the other vertical louvers so that said plurality of louvers move together as a system.

* * * * *